United States Patent [19]

Sorber

[11] Patent Number: 4,614,057

[45] Date of Patent: Sep. 30, 1986

[54] AUTOMATIC OPERATING SYSTEM AND METHOD FOR SWINGING DOORS

[75] Inventor: Robert Sorber, Charlotte, N.C.

[73] Assignee: Keane Monroe Corporation, Monroe, N.C.

[21] Appl. No.: 752,775

[22] Filed: Jul. 8, 1985

[51] Int. Cl.[4] ..... E05F 15/20

[52] U.S. Cl. ..... 49/29; 49/31; 49/264; 49/28

[58] Field of Search ..... 49/29, 30, 31, 28, 26, 49/264

[56] References Cited

U.S. PATENT DOCUMENTS

| | | | |
|---|---|---|---|
| 2,843,376 | 7/1958 | Osuch . | |
| 2,869,861 | 1/1959 | Carlson . | |
| 3,003,317 | 10/1961 | Schroeder et al. . | |
| 3,323,255 | 6/1967 | Sweetland, Jr. et al. . | |
| 3,874,117 | 4/1975 | Boehm | 49/30 X |
| 4,272,921 | 6/1981 | Jorgensen . | |
| 4,458,446 | 7/1984 | Mochida et al. | 49/28 |
| 4,467,391 | 8/1984 | Refoy et al. | 49/264 X |
| 4,476,678 | 10/1984 | Hall . | |

*Primary Examiner*—Kenneth Downey

*Attorney, Agent, or Firm*—Shefte, Pinckney & Sawyer

[57] ABSTRACT

An automatic mat-activated operating system for swinging doors provides approach circuitry for opening the doors when an approach mat at the entrance side of the doorway is activated and override safety circuitry for stopping door opening movement and returning the doors to a closed position when a safety mat at the exit side of the doorway is activated within a predetermined initial range of door movement but not thereafter and also for preventing door opening movement if the safety mat is already activated at the time of initial activation of the approach mat. The control system thus protects pedestrians at the exit side of the doorway from being struck by the doors during their initial opening movement which may not be readily recognizable and avoidable and also protects pedestrians entering the doorway from the entrance side from being struck by unexpected return movement of the doors.

8 Claims, 2 Drawing Figures

AUTOMATIC OPERATING SYSTEM AND METHOD FOR SWINGING DOORS

BACKGROUND OF THE INVENTION

Automatically-operated swinging door structures of various types are well-known and in widespread commercial use. Such door structures are characteristically intended and designed for one-way use with the door swinging away from the entrance side of the doorway toward its exit side. Typically, the swinging operation of the door is electromechanically controlled by actuation from a weight sensitive mat, a photoelectric eye or a similar device for sensing the approach or presence of a person or object requiring opening of the door.

The swinging operation of such doors is recognized to represent a danger or injury to persons at the exit side of the doorway. Therefore, in the past, it has become conventional to utilize a safety mat or a similar sensor to detect the presence of a person or object within the opening path of the door and to prevent the initiation of opening operation of the door under such conditions. Some prior control systems have also incorporated a time delay in conjunction with the safety mat or other sensor to delay deactivation of the safety mat a short time period following each activation thereof. Such time delays serve the two-fold purpose of delaying closing movement of an opened door to permit the pedestrian entering the door from the entrance side to step clear from the safety mat before closing movement of the door begins, as well as to protect a pedestrian on the exit side of the door from opening movement thereof if the pedestrian momentarily shifts his or her weight to a dead spot on the mat or otherwise momentarily deactivates the mat without stepping from it. An example of this type of swinging door control arrangement is disclosed in Boehm U.S. Pat. No. 3,874,117. While such control systems operate effectively for these intended purposes, such systems make no provision for protecting a pedestrian who activates the safety mat after activation of the approach mat has occurred and door opening movement has begun.

As represented by Bond et al U.S. Pat. No. 3,195,879, other swinging door operating arrangements provide for stopping of the swinging door during opening or closing movement when activation of the safety mat occurs. In Bond et al, two safety mats are arranged in series at the exit side of the doorway for this purporse. These control systems also operate effectively in their intended manner but suffer the disadvantage that, when the door is stopped upon safety mat activation, the door is prevented from further opening or closing movement until deactivation of the safety mat.

Other swinging door systems operate to effect closing of the door at substantially any time during the opening operation thereof when the door encounters an object in its swinging path. Eller et al U.S. Pat. No. 4,263,746, discloses an exemplary control system of this type wherein a door-reversing safety arrangement is provided to return the door to its previous closed or open condition at substantially any time the door encounters an object during opening or closing movement, except that a very short time delay is built into the control system to prevent reversal of the door movement during the initiation of each opening and closing movement in order to permit the hydraulic operating system for the door to get underway before the reversing safety arrangement becomes operational. This type of door operating system is considered more disadvantageous than systems of the type of the Bond et al patent in that actual striking contact of the moving door with a pedestrian or other object must occur before door reversal is actuated. Furthermore, the operation of the Eller et al type of system for returning the opening door to its previous closed position at any time after the opening movement is initiated, even when the door is almost fully opened, creates a danger of injury to the person entering the doorway from the entrance side which is at least equal to the danger to the pedestrian or object at the exit side which the Eller et al system seeks to avoid.

SUMMARY OF THE INVENTION

In contrast, the present invention provides an improvement in automatic swinging door control systems and methods for effecting closing movement of an opening door only when safety mat activation occurs within an initial predetermined range of opening movement of the door following approach mat activation, in order to minimize and substantially eliminate dangers to pedestrians at the exit side of the doorway as well as to pedestrians entering the doorway.

Basically, the automatic door operating systems to which the present improvement relates comprise a doorway having an entrance side and an exit side, a door supported in the doorway for swinging movement between a closed position separating the entrance and exit sides and an open position on the exit side, an arrangement such as an approach mat for sensing a pedestrian or object at the entrance side of the doorway, another arrangement such as a safety mat for sensing an object at the exit side of the doorway, and an actuator or other arrangement for actuating the swinging movement of the door. According to the present invention, a control system is provided in operative association with each of the mats or other sensing arrangements and with the actuator for controlling the operation of the actuator in relation to the mats or other sensors. The control system includes a primary operating arrangement for causing the actuator automatically to swing the door in an opening direction from its closed position to its open position and then automatically to return the door in a closing direction from its open position to its closed position when the approach mat or other approach sensor senses an object at the entrance side of the doorway. The control system also includes an override arrangement for causing the actuator to automatically stop swinging movement of the door in the opening direction and then automatically to return the door in the closing direction when the safety mat or other safety sensor senses an object at the exit side of the doorway while the door is within a predetermined initial range of swinging movement in the opening direction. The override arrangement is also operative to prevent swinging movement of the door in the opening direction from its closed position while the safety mat or other safety sensor senses an object at the exit side of the doorway. Preferably, the override arrangement includes a timing system operatively associated with the primary operating arrangement to be activated upon each door opening operation of the primary operating arrangement for disenabling the override arrangement after elapse of a predetermined time corresponding to the time required for opening the door the predetermined initial range of movement.

In the preferred embodiment, the approach and safety mats or other sensors each include a switch operatively connected with a source of electrical power. The primary operating arrangement includes an approach circuit electrically connecting the approach switch and the actuator for supplying operating electrical power to the actuator upon closing of the approach switch. The override arrangement includes a saftey circuit electrically connecting the safety switch and the approach circuit, and also includes a logic arrangement operatively associating the safety and approach circuits for stopping and preventing the supply of operating electrical power to the actuator when the safety switch is closed at the time the approach switch becomes closed and when the safety switch is closed during the initial range of door swinging movement. The logic arrangement includes a time delay circuit operatively associated with the approach circuit and the safety circuit to receive an output signal from the approach circuit when it supplies door opening electrical power to the actuator. The time delay circuit transmits a disenabling signal to the safety circuit after the aforesaid predetermined time elapses for thereafter preventing the safety circuit from stopping the supply of electrical power by the approach circuit to the actuator. Preferably, the time delay circuit utilizes electrical resistors for delaying the transmission of the disenabling signal to the safety circuit. It is also preferred that the logic arrangement utilize NAND gates in each of the approach and safety circuits for causing the approach circuit to produce an enabling output signal to the actuator for door opening actuation upon closing of the approach switch when the safety switch is open, for causing the approach circuit to produce a disenabling output signal to the actuator when the approach switch is closed while the safety switch is closed, and for causing the approach circuit to change from the enabling signal to the disenabling signal when the safety switch becomes closed within the aforesaid predetermined time delay period.

DESCRIPTION OF THE PREFERRED EMBODIMENT

Figure 1:
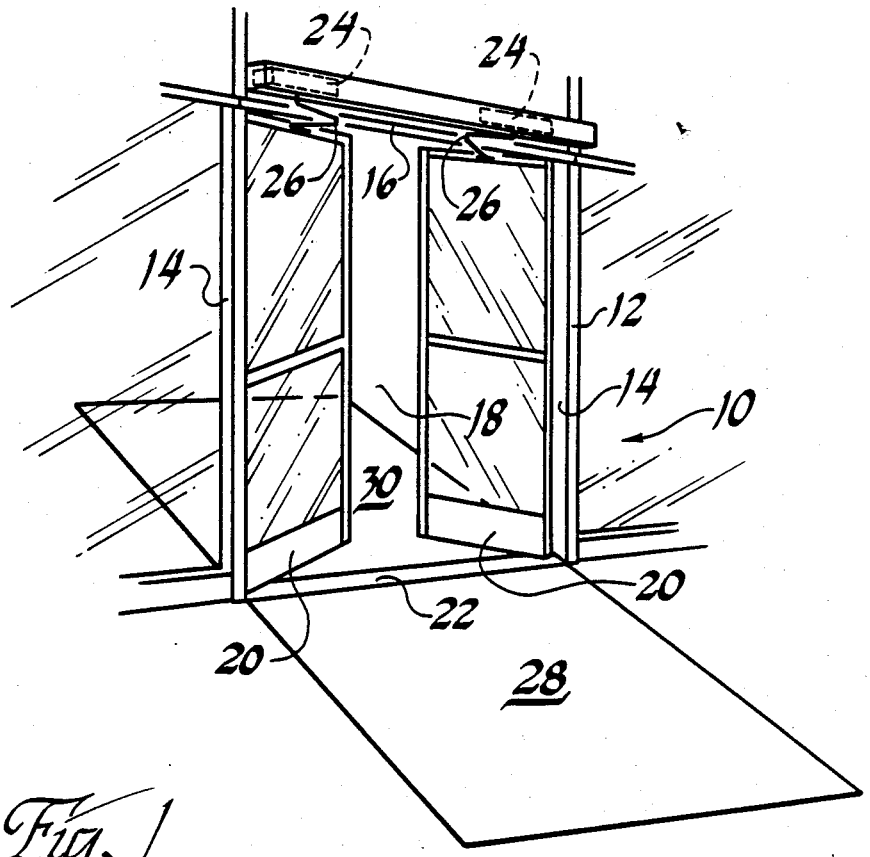
FIG. 1 is a perspective view of a conventional swinging door structure in which the improved door operating system of the present invention is preferably embodied.
Figure 2:
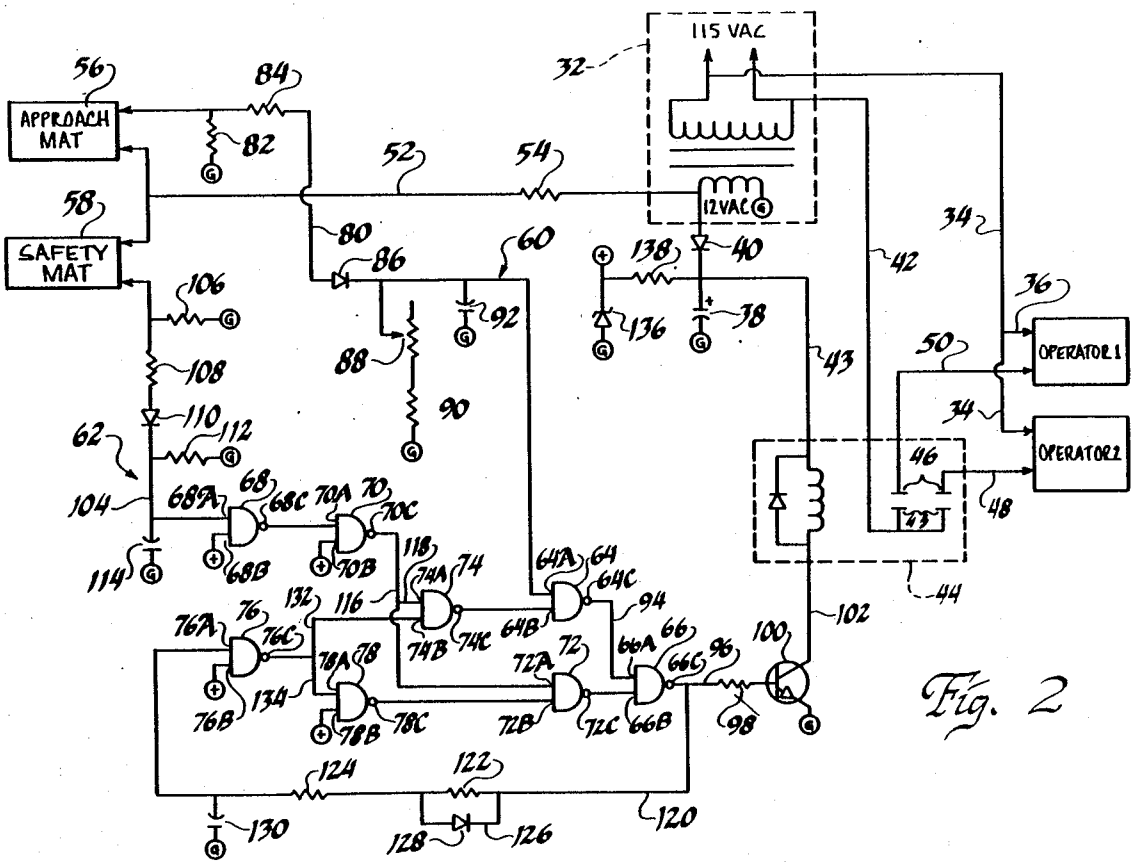
FIG. 2 is a schematic diagram of the preferred embodiment of the improved control circuitry of the present invention for controlling the opening and closing movements of the door structure of FIG. 1.

Referring now to the accompanying drawings, the control circuitry of the present invention, illustrated schematically in FIG. 2, is herein illustrated and described as preferably embodied for controlling the opening and closing actuation of a swinging door structure generally indicated at 10 in FIG. 1.

The swinging door structure 10 is of the conventional type having an upright door frame 12 including a pair of vertical door jambs 14 connected at their upper ends by a horizontal transom 16 to define a doorway 18 therethrough. A pair of doors 20 are pivotably mounted in upright disposition at the lateral sides of the frame 12 to the transom 16 and to a horizontal base plate 22 extending between the lower ends of the door jambs 14 for pivotal movement of the doors 20 about respective vertical axes. A pair of door operators 24 are housed within the transom 16 at each lateral end thereof and are respectively connected by pivoting arms 26 to the doors 20 to actuate simultaneous opening and closing movements of the doors 20. The operators 24 are of the conventional type providing electrohydraulically powered opening movement of the doors 20 and spring operated closing movement of the doors 20. The door structure 10 is designed and intended for one-way traffic from the entrance side of the doorway, i.e. the foreground of FIG. 1, to its exit side of the doorway, i.e. the background of FIG. 1, with the doors 20 arranged for swinging pivotal movement between a closed position wherein the doors 20 separate the entrance and exit sides of the doorway, and an open position of the doors 20 swung to the exit side of the doorway. In FIG. 1, the doors 20 are shown at an intermediate position as in the process of opening or closing movement. A pair of actuating mats 28,30 are positioned on opposite sides of the doorway 18, the mat 28 being positioned at the entrance side of the doorway to provide an approach mat onto which pedestrians entering the doorway step and the mat 30 being positioned at the exit side of the doorway to provide a safety mat onto which entering pedestrians step from the approach mat 28 and also for permitting control of the opening and closing movements of the doors 20 in relation to pedestrian traffic on the exit side of the doorway, as hereinafter explained. Each mat 28,30 is operatively associated with an appropriate hydraulic actuating arrangement which in turn is connected operatively with a conventional electrical switch, representatively indicated at 56,58 in FIG. 2, to be sensitive to the weight of an object or pedestrian supported on the mats 28,30 to sense the presence thereof and in turn to close the associated switch 56 or 58. Of course, as will be readily understood, the present control system is equally applicable to be embodied in association with door structures having only one swinging door as well as to substantially any other conventional automatically operated swinging door structure. Furthermore, it will also be understood that any other suitable sensing device or system, such as photoelectric eyes, microwave sensors, etc., may be utilized instead of weight-sensitive mats for sensing pedestrian presence at the door structure. Preferably, the door structures with which the present control system is utilized are any of the "K-M Series 2000" or "Series 4500" swinging doors manufactured and sold by Keane Monroe Corporation of Monroe, N.C.

Referring now to FIG. 2, there is schematically illustrated the control circuitry of the present invention by which the actuation of the operators 24 for opening and closing movements of the doors 20 is controlled in relation to the sensing operation of the approach and safety mats 28,30. A transformer 32 is connected with an ordinary electrical power source delivering conventional alternating current line voltage at 115 VAC and is operatively connected through line 34 and branch line 36 to each electrohydraulic operator 24. Another line 42 delivers the line voltage to a pair of input contacts 45 of a relay 44 and a correspondingly respective pair of output contacts 46 of the relay 44 are connected through lines 48,50 to the electrohydraulic operators 24. Thus, complete circuits are provided to the operators 24 to supply the 115 VAC line voltage to the operators 24 when the relay 44 is energized to close the contacts 45,46 and to prevent power supply to the operators 24 when the relay 44 is de-energized to open the contacts 45,46. The transformer 32 also operates in conventional manner to convert the 115 VAC line voltage to a 12 VAC power output. A 1,000 microfarad capacitor 38 is connected through a diode 40 to the 12 VAC power output of the transformer 32 to supply unregulated direct current power through a line 43 to the coil of the relay 44 for facilitating selective energization of the relay 44 as hereinafter explained. The coil of the relay 44 is also connected through a line 102 with a transistor 100 for purposes also hereinafter explained.

The 12 VAC power output of the transformer 32 is electrically connected through a line 52 and through a 100 ohm resistor 54 therein to one contact of each of the approach and safety mat switches 56,58 for supplying such voltage to each switch. An approach circuit, indicated generally at 60, electrically connects the approach mat switch 56 with the coil of the relay 44 to deliver energizing current to the relay 44 to actuate the electrohydraulic operators 24, as hereinafter more fully described. An override arrangement, including a safety circuit indicated generally at 62 which electrically connects the safety mat switch 58 with the approach circuit 60 and a logic arrangement of plural logic gates 64,66,68,70,72,74,76,78 providing operative association between the approach and safety circuits 60,62, is provided for stopping or preventing the energization of the relay 44 upon certain activations of the safety mat switch 58, as also hereinafter described. All such logic gates are dual input NAND gates having Schmidt trigger hysteresis on the inputs to the gates. Preferably, such NAND gates are standard CMOS integrated circuits, MC14093 or the equivalent.

The approach circuit 60 includes a line 80 to which a grounded 510 ohm resistor 82 is electrically connected immediately following the approach mat switch 56. Another 4,700 ohm resistor 84 and a diode 86 are arranged in series in the line 80 following the resistor 82. A 5,000,000 ohm variable resistor 88 is electrically connected to the approach circuit line 80 following the diode 86 and the variable resistor 88 is in turn electrically connected to a grounded 100,000 ohm resistor 90. A grounded 10 microfarad capacitor 92 is electrically connected to the approach circuit line 80 following the variable resistor 88. As will be understood, the described arrangement of the resistors 82,84,88,90, the diode 86 and the capacitor 92 serve to rectify the 12 VAC alternating current input from the transformer 32 to direct current and to limit such current to prevent damage to the logic gates, all in conventional manner. Additionally, the variable resistor 88 and the capacitor 92 provide a selectively variable time delay between each opening deactivation of the approach mat switch 56 and the resultant deactivation of the approach circuit 60.

The approach circuit line 80 is electrically connected to one input pin 64A of the NAND gate 64 and the output pin 64C of the NAND gate 64 is electrically connected through an approach circuit line 94 to one input pin 66A of the NAND gate 66. The output pin 66C of the NAND gate 66 is connected through another approach circuit line 96 and through a 36,000 ohm resistor 98 to the transistor 100.

The safety circuit 62 similarly includes a line 104 electrically connected to and extending from the safety mat switch 58. A grounded 510 ohm resistor 106 is electrically connected to the safety circuit line 104 immediately following the safety mat switch 58, and a 10,000 ohm resistor 108 and a diode 110 are arranged in series in the line 104 following the resistor 106. A grounded 470,000 ohm resistor 112 is electrically connected to the safety circuit line 104 following the diode 110 and a grounded 1.5 microfarad capacitor 114 is electrically connected to the line 104 following the resistor 112. As in the approach circuit 60, the resistors 106,108,112, the diode 110 and the capacitor 114 function in conventional manner to rectify the 12 VAC alternating current input from the transformer 32 to direct current and to limit such current to prevent damage to the logic gates. The capacitor 114 additionally provides an approximately three-quarter second time delay between opening deactivation of the safety mat switch 58 and the resultant deactivation of the safety circuit 62.

Line 104 is electrically connected to one input pin 68A of NAND gate 68, the output pin 68C of which is electrically connected to one input pin 70A of the NAND gate 70. The output pin 70C of the NAND gate 70 is electrically connected through a line 116 to one input pin 72A of the NAND gate 72 and through a branch line 118 to one input pin 74A of the NAND gate 74. The output pin 74C of the NAND gate 74 is electrically connected to the other input pin 64B of the NAND gate 64 and the output pin 72C is electrically connected to the other input pin 66B of the NAND gate 66. Another safety circuit line 120 is electrically connected to the approach circuit line 96 and has a 56,000 ohm resistor 122 and a 4,700 ohm resistor 124 arranged in series in the line 120. A bypass line 126 is electrically connected to the line 120 on opposite sides of the resistor 122 and has a diode 128 in the line 126. A grounded 10 microfarad capacitor 130 is also electrically connected to the line 120 following the resistor 124. The line 120 is connected following the capacitor 130 to one input pin 76A of the NAND gate 76. The output pin 76C of the NAND gate 76 is electrically connected through one line 132 to the other input pin 74B of the NAND gate 74 and through a line 134 to one input pin 78A of the NAND gate 78. The output pin 78C of the NAND gate 78 is electrically connected to the other input pin 72B of the NAND gate 72. The other input pins 68B,70B,76B,78B are each electrically connected to a positive supply of regulated DC voltage from a zener diode 136 which is connected through a 1,000 ohm resistor 138 to the capacitor 38.

In operation of the present control system, no voltage is supplied to either the approach or safety circuits 60,62 when the approach and safety mats 28,30 are deactivated, i.e. the approach and safety mat switches 56,58 are open. When a pedestrian steps onto, or an object is placed onto, the approach mat 28, the approach mat switch 56 is closed supplying alternating current from the line 52 from the transformer 32 to the approach circuit line 80. This alternating current is rectified to direct current by the diode 86, and the capacitor 92, resulting in a positive voltage signal being applied to the input pin 64A of the NAND gate 64. The resistor 84 limits the amount of current in the line 80 to prevent damage to the various NAND gates. So long as the safety mat 30 remains deactivated with its safety mat switch 58 open, no current is supplied to the safety mat circuit line 104 and, in turn, no current is supplied to the input pin 68A of the NAND gate 68, whereby an effectively negative input signal is applied through the resistor 112 to the input pin 68A. As a result, the NAND gate 68 generates a positive output signal which is delivered to the input pin 70A of the NAND gate 70. Since both inputs 70A,70B to the NAND gate 70 are thereby positive, the NAND gate 70 produces a negative output signal which accordingly is delivered to each of the inputs 72A,74A of the NAND gates 72,74, whereby each NAND gate 72,74 produces a positive output signal. Accordingly, both inputs 64A,64B to the NAND gate 64 are positive and the NAND gate 64 thereby produced a negative output signal which is delivered to the input pin 66A of the NAND gate 66. The NAND gate 66, having negative and positive input signals applied respectively to its input pins 66A,66B, produces a positive output signal which is supplied through the line 96 to the transistor 100. The transistor 100 is arranged to permit current flow therethrough to provide a closed circuit to the relay 44 when the output from the NAND gate 66 is positive and accordingly transmits the positive output signal through the line 102 to the relay 44 to energize it. In turn, the relay contacts 45,46 close and permit supply of the line voltage to the operators 24 to actuate opening movement of the doors 20. As is conventional, the operators 24 each have internal limit switches (not shown) which deactuate the operators 24 to stop the opening movement of the doors 20 when the doors 20 reach their predetermined fully open positions. The operators 24 have conventional spring-operated door return mechanisms (also not shown) against which the door opening movement operates to load the spring mechanisms for effecting return movement of the doors 20 to their closed positions following deactivation of the operators 24 by the limit switches.

The positive output signal from the NAND gate 66 is also transmitted through the line 120 but, because of the resistivity of the resistors 122,124 is delayed a short period of time in reaching the input pin 76A of the NAND gate 76. During this time delay, the input and output states of the various NAND gates are unchanged from that above-described. Specifically, an effectively negative signal prevails on the input 76A to the NAND gate 76 producing a positive output therefrom which is supplied to the input 78A of the NAND gate 78 and to the input 74B of the NAND gate 74. The NAND gate 78 therefore has a dual positive input and produces a negative output which is delivered to the input 72B of the NAND gate 72. As previously mentioned, the NAND gates 72,74 each produce positive outputs as a result of their described negative inputs. Once the positive signal from the line 96 is transmitted through the line 120 and reaches the input pin 76A, the output of the NAND gate 76 becomes negative as a result of the then prevailing dual positive input to the NAND gate 76. The new negative output signal from the NAND gate 76 is supplied to the input 78A of the NAND gate 78 to change its output to a positive signal and the new positive output of the NAND gate 78 is supplied to the input 72B of the NAND gate 72. However, since the other input 72A to the NAND gate 72 remains negative, the output of the NAND gate 72 remains positive. The new negative output of NAND gate 76 is also supplied to the input 74B of the NAND gate 74, the output of which also remains positive since the other input 74A remains negative. Thus, the change in the input and/or output states of NAND gates 72,74,76,78 caused by the positive signal transmitted through the line 120 does not affect or change the input and output states of NAND gates 64,66 and therefore the door operators 24 continue their door opening operation with out interruption.

If a pedestrian steps on the safety mat 30 in advance of pedestrian activation of the approach mat 28 so that the safety mat switch 58 is already closed at the time of the closing of the approach mat switch 56, the activation of the approach mat 28 will not be effective to actuate the electrohydraulic operators 24. Upon closing of the safety mat switch 58, alternating current from the transformer 32 is supplied to the safety circuit line 104 and this alternating current is rectified to direct current by the diode 110 and the capacitor 114 resulting in a positive voltage signal being applied to the input 68A of the NAND gate 68. The resistor 108 limits the current in the line 104 to prevent damage to the various NAND gates. Since both inputs 68A,68B are thereby positive, the NAND gate 68 produces a negative output signal which is applied to the input 70A of the NAND gate 70 causing its output to become positive. The positive output from the NAND gate 70 is thus supplied to the inputs 72A,74A of the NAND gates 72,74. No current is effectively applied to the input 76A of the NAND gate 76, i.e, an effectively negative input signal, so that the NAND gate 76 produces a positive output signal which in turn is supplied to the input 78A of the NAND gate 78 and the input 74B of the NAND gate 74. Thus, each of the NAND gates 74,78 have dual positive inputs and therefore produce negative output signals which are respectively applied to the input 64B of the NAND gate 64 and the input 72B of the NAND gate 72. This negative input to the NAND gate 64 causes it to produce a positive output signal which is supplied to the input 66A of the NAND gate 66. The NAND gate 72 having positive and negative inputs to its respective input pins 72A,72B, produces a positive output signal which is supplied to the input 66B of the NAND gate 66. Thus, the NAND gate 66 has a dual positive input and thereby produces a negative output signal. When the approach mat 28 is activated to close the approach mat switch 56, the positive signal supplied to the input 64A of the NAND gate 64 is not effective to change the output of the NAND gate 64 since a negative input signal is already applied to the input 64B. Accordingly, the negative output of NAND gate 66 continues and is prevented by the transistor 100 from being transmitted to the relay 44. Accordingly, the relay 44 does not become energized and the operators 24 remain inactive so that the doors 20 do not open.

The negative output signal from the NAND gate 66 is also transmitted through the line 120 and is permitted by the diode 128 in the bypass line 126 to be transmitted relatively without delay to the input 76A to the NAND gate 76. Since the previous absence of a current supply to the input 76A produced an effectively negative input thereto, the negative signal does not produce any change in the output state of NAND gate 76 and, therefore, the input and output states of the other logic gates remain unchanged.

If a pedestrian steps on the safety mat 30 after the approach mat 28 has been activated and resultant door opening operation has begun, the effect of the closing of the safety mat switch 58 and the resultant supply of current to the safety circuit 62 will depend on the amount of elapsed time between the closing of the approach mat switch 56 and the closing of the safety mat switch 58. As previously explained, the initial closing of the approach mat switch 56 prior to the activation of the safety mat 30 produces the above-described state of the control circuitry to achieve a positive output signal from the NAND gate 66 to energize the relay 44 and actuate the operators 24, and the positive output signal from the NAND gate 66 is also transmitted through the line 120 to the input 76A after a short delay period. Accordingly, during the time delay period following activation of the approach mat 28 and resultant energization of the relay 44, no current is supplied to the input 76A of the NAND gate 76 so that such input remains effectively negative and the output of the NAND gate 76 remains positive. Therefore, if the safety mat 30 is activated during the time delay period to supply a positive signal to the input 68A of the NAND gate 68, the input and output states of the various NAND gates will then become the same as described above for the situation in which the safety mat 30 is activated before the approach mat 28. Specifically, the output from the NAND gate 74 will change from positive to negative as a result of the positive input received by the input pin 74A from the NAND gate 70. Thus, the output from the NAND gate 64 will change from negative to positive as a result of the new negative input signal to the input pin 64B received from the NAND gate 74. The output from the NAND gate 72 remains positive since the input to its input pin 72B from the NAND gate 78 remains negative under the control of the yet unchanged NAND gate 76. Thus, the NAND gate 66 obtains a dual positive input to change the output of the NAND gate 66 to negative, whereby the transistor 100 immediately stops the supply of energizing current to the relay 44 and the door opening operations of the operators 24 resultingly cease, at which time the spring mechanisms of the operators 24 become effective to return the doors 20 to their originally closed positions.

On the other hand, if the safety mat 30 is activated after the period of the time delay has elapsed, the positive output from the NAND gate 66 will have reached the input 76A to the NAND gate 76 to cause its output to become negative and thereby producing the above-described changes in the input and/or output states of the NAND gates 72,74,78. Specifically, the negative output of the NAND gate 76 is applied to the input 78A of the NAND gate 78 and to the input 74B of the NAND gate 74. While the safety mat 30 remains deactivated, this change in the input 74B effects no change in the output state of the NAND gate 74 since its other input 74A remains negative. The output of the NAND gate 78, however, is changed from negative to positive since it no longer has a dual positive input. However, the new negative output of the NAND gate 78 does not effect any change in the output of the NAND gate 72 since its input 72A remains negative. Accordingly, these changes in state of the NAND gates 72,74,76,78 do not effect any change of the NAND gates 64,66 and do not affect the continued operation of the operators 24. When the safety mat 30 is activated after these changes have occurred, the output of the NAND gate 70 will become positive, as above-described, to supply a positive signal to the inputs 72A,74A of the NAND gates 72,74. However, since the input 74B to the NAND gate 74 has become negative, the output signal from the NAND gate 74 remains positive. The output of the NAND gate 72 changes to a negative signal since both its inputs 72A,72B are now positive. However, since no change occurs in the input or output states of the NAND gate 64, a negative input signal continues to be supplied to the input 66A of the NAND gate 66 so that the NAND gate 66 continues to produce a positive output signal and, accordingly, the relay 44 remains energized and the operators 24 continue to effect opening movement of the doors 20.

As previously indicated, upon any door opening activation of the approach circuit 60, the variable resistor 88 and the capacitor 92 provide a selectively variable time delay between the opening of the approach mat switch 56 and the resultant deactivation of the approach circuit 60, thereby providing sufficient time for the pedestrian who activated the approach mat 28 to proceed through the remainder of the doorway 18 after stepping from the approach mat 28 to the exit side of the doorway. As desired, this time delay may be varied to suit differing traffic conditions and situations. Similarly, upon any activation of the safety circuit 62, the capacitor 114 in the safety circuit 62 provides a time delay of approximately three-fourths of a second between the opening of the safety mat switch 58 and the resultant deactivation of the safety circuit 62 to maintain the safety circuit 62 activated when a pedestrian thereon momentarily shifts weight or otherwise only momentarily opens the safety mat switch 58 without stepping from the safety mat 30.

The present control system provides significant advantages over the above-described conventional door operating systems in that appropriate provision is made for the safety of pedestrians both on the entrance and exit sides of the doorway. As mentioned, a pedestrian within the path of opening movement of the doors on the exit side of the doorway must be protected from being struck by the opening doors, but also pedestrians entering the doorway from the entrance side must be protected from being struck upon unexpectedly premature closing movement of the doors after opening actuation thereof has begun. In theory, the greatest danger to pedestrians on the exit side of the doorway exists when they are in the path of the doors at the time they begin opening or when they come into the path of door movement shortly thereafter since it is not possible or is at least difficult for such pedestrians to foresee or recognize opening movement of the doors when the doors are closed or just starting to open. After the doors have opened to a sufficient degree that their opening movement is readily recognizable, pedestrians on the exit side of the doorway should be easily capable of avoiding the opening path of the doors. Conversely, pedestrians entering the doorway from the entrance side encounter relatively little danger by the unexpected closing of the doors when they have only slightly opened since the pedestrian will not have advanced any significant degree through the doorway. However, this danger to entering pedestrians increases as the doors open further and as the pedestrian advances further through the doorway. Thus, to minimize the danger to each class of pedestrian, the present invention provides the above-described safety circuitry and the logic gate arrangement and time delay associated therewith to cause the doors to return closed after opening actuation has begun only when the safety mat is activated within a predetermined initial range of opening movement of the doors, but is effective to permit the doors to continue their opening operation when the safety mat is activated after the doors have advanced beyond such initial range of opening movement. For this purpose, the resistivity of the line 120 to transmission of the positive signal from the NAND gate 66 to the NAND gate 76 is established to provide a delay in such signal transmission which is a predetermined portion of the overall time required to complete actuation of full opening movement of the doors. The delay is selected to correspond to the fractional time required to open the doors through the predetermined initial range of movement within which it is desired that the doors be closed if the safety mat becomes activated and beyond which it is desired that the doors be permitted to continue opening even if the safety mat becomes activated thereafter. As will be understood, the selection of this time delay and of the appropriate resistivity for the line 120 is important to insure maximum protection to each class of pedestrians and necessarily the appropriate time delay will vary for each different door control system in relation to its overall time and speed of operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an automatic door operating system of the type comprising a doorway having an entrance side and an exit side, a door, means supporting said door in said doorway for swinging movement between a closed position separating said entrance and exit sides and an open position on said exit side, first means for sensing an object at said entrance side of said doorway, second means for sensing an object at said exit side of said doorway, and means for actuating said swinging movement of said door, the improvement comprising control means operatively associated with each said first and second sensing means and with said actuating means for controlling operation of said actuating means in relation to said first and second sensing means, said control means including primary operating means for causing said actuating means automatically to swing said door in an opening direction from said closed position to said open position and then automatically to return said door in a closing direction from said said open position to said close position when said first sensing means senses an object at said entrance side of said doorway and override means for causing said actuating means automatically to stop said swinging movement of said door in said opening direction and then automatically to return said door in said closing direction to said closed position when said second sensing means senses an object at said exit side of said doorway while said door is within a predetermined initial range of said swinging movement in said opening direction and for preventing said swinging movement of said door in said opening direction from said closed position while said second sensing means senses an object at said exit side of said doorway.

2. The improvement in an automatic door operating system according to claim 1 and characterized further in that said override means includes timing means operatively associated with said primary operating means to be activated upon each door opening operation of said primary operating means for disenabling said override means after elapse of a predetermined time corresponding to the time required for opening said door said predetermined initial range.

3. The improvement in an automatic door operating system according to claim 1 and characterized further in that said first sensing means includes first switch means operatively connected with a source of electrical power, said second sensing means includes second switch means operatively connected with a source of electrical power, said primary operating means includes approach circuit means electrically connecting said first switch means and said actuating means for supplying operating electrical power to said actuating means upon closing of said first switch means, and said override means includes safety circuit means electrically connecting said second switch means and said approach circuit means and logic means operatively associating said safety circuit means and said approach circuit means for stopping and preventing said supplying operating electrical power to said actuating means when said second switch means is closed at the time said first switch means becomes closed and when said second switch means is closed during said initial range of door swinging movement.

4. The improvement in an automatic door opening system according to claim 3 and characterized further in that said logic means includes time delay circuit means operatively associated with said approach circuit means and said safety circuit means to receive an output signal from said approach circuit means upon its said supplying of door opening electrical power to said actuating means and to transmit a disenabling signal to said safety circuit means after elapse of a predetermined time corresponding to the time required for opening said door said predetermined initial range for thereafter preventing said stopping operation of said safety circuit means.

5. The improvement in an automatic door opening system according to claim 4 and characterized further in that said time delay circuit means includes resistor means for delaying transmission of said disenabling signal to said safety circuit means.

6. The improvement in an automatic door opening system according to claim 3 and characterized further in that said logic means includes NAND gate means in each of said approach circuit means and said safety circuit means for causing said approach circuit means to produce an enabling output signal to said actuating means for door opening actuation thereof upon closing of said first switch means when said second switch means is open, for causing said approach circuit means to produce a disenabling output signal to said actuating means when said first switch means is closed while said second switch means is closed, and for causing said approach circuit means to change said enabling signal to said disenabling signal when said second switch means becomes closed within said predetermined time.

7. In a method of automatically operating a door in a doorway having an entrance side and an exit side wherein said door is supported for swinging movement between a closed position separating said entrance and exit sides and an open position on said exit side, said method comprising the steps of sensing an object at said entrance side of said doorway and sensing an object at said exit side of said doorway, the improvement comprising controlling said swinging movement of said door between its said closed and open positions by performing the steps of automatically swinging said door in an opening direction from said closed position to said open position and then automatically returning said door in a closing direction from said open position to said closed position when said sensing an object at said entrance side of said doorway, stopping said swinging movement of said door in said opening direction and automatically returning said door in said closing direction to said closed position when said sensing an object at said exit of said doorway while said door is within a predetermined initial range of said swinging movement in said opening direction, and preventing said swinging movement of said door in said opening direction from said closed position while said sensing an object at said exit side of said doorway.

8. The improvement in a method of automatically operating a door according to claim 7 and characterized further in that said stopping includes timing said swinging movement of said door in said opening direction upon each said sensing an object at said entrance side of said doorway and disenabling said stopping after elapse of a predetermined time required for opening said door said predetermined initial range.

* * * * *